US010098520B2

(12) United States Patent
Dirisala et al.

(10) Patent No.: US 10,098,520 B2
(45) Date of Patent: Oct. 16, 2018

(54) DISHWASHER WITH A MULTI-LAYER ACOUSTIC MATERIAL IN A CONDENSING DRYING SYSTEM

(71) Applicant: WHIRLPOOL CORPORATION, Benton Harbor, MI (US)

(72) Inventors: Venkata S. Dirisala, Benton Harbor, MI (US); Aaron P. Bennett, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 60 days.

(21) Appl. No.: 15/065,232

(22) Filed: Mar. 9, 2016

(65) Prior Publication Data

US 2017/0258292 A1 Sep. 14, 2017

(51) Int. Cl.

| | |
|---|---|
| ***A47L 15/48*** | (2006.01) |
| ***A47L 15/42*** | (2006.01) |
| ***A47L 15/50*** | (2006.01) |
| ***A47L 15/22*** | (2006.01) |
| ***A47L 15/16*** | (2006.01) |

(52) U.S. Cl.

CPC ..... *A47L 15/488* (2013.01); *A47L 15/16* (2013.01); *A47L 15/22* (2013.01); *A47L 15/4261* (2013.01); *A47L 15/483* (2013.01); *A47L 15/507* (2013.01)

(58) Field of Classification Search

None

See application file for complete search history.

(56) References Cited

U.S. PATENT DOCUMENTS

| | | | | |
|---|---|---|---|---|
| 5,524,358 | A | 6/1996 | Matz | |
| 5,709,925 | A * | 1/1998 | Spengler | B29C 70/021 428/198 |
| 6,090,478 | A * | 7/2000 | Nishizaki | B32B 5/02 428/297.4 |
| 6,512,831 | B1 * | 1/2003 | Herreman | D06F 39/12 181/198 |
| 8,696,824 | B2 | 4/2014 | Jadhav et al. | |
| 8,758,525 | B2 * | 6/2014 | Kim | A47L 15/486 134/105 |
| 2011/0048850 | A1 * | 3/2011 | Alexander | E04B 1/8409 181/296 |
| 2013/0008474 | A1 * | 1/2013 | Thayyullathil | A47L 15/488 134/95.2 |

(Continued)

FOREIGN PATENT DOCUMENTS

| | | | | |
|---|---|---|---|---|
| DE | 102012203321 | A1 | 9/2013 | |
| EP | 2372012 | A1 * | 10/2011 | A47L 15/483 |

(Continued)

*Primary Examiner* — Jason Y Ko
*Assistant Examiner* — Cristi J Tate-Sims
(74) *Attorney, Agent, or Firm* — McGarry Bair PC

(57) ABSTRACT

A dishwasher can comprise a tub to at least define a treating chamber. The treating chamber can have an access opening with a cover selectively permitting access to the treating chamber. The condenser assembly can be made of a multi-layer absorptive acoustic material, which attenuates sound emanating from the treating chamber and travelling through the condensing section. The sounds attenuation can provide for reducing or eliminating the need for sound insulation necessary within the dishwasher.

21 Claims, 8 Drawing Sheets

(56) References Cited

U.S. PATENT DOCUMENTS

2013/0298585 A1* 11/2013 Je ..... G10K 11/002
62/238.7
2015/0245760 A1* 9/2015 Bewley, Jr. ..... A47L 15/4257
454/49

FOREIGN PATENT DOCUMENTS

GB 2405159 A * 2/2005 ..... E04B 1/86
WO WO 2013042036 A1 * 3/2013 ..... A47L 15/481

* cited by examiner

DISHWASHER WITH A MULTI-LAYER ACOUSTIC MATERIAL IN A CONDENSING DRYING SYSTEM

BACKGROUND OF THE INVENTION

Automatic dishwashers for use in a typical household include a tub defining a treating chamber and a spraying system for recirculating liquid throughout the tub to remove soils from the dishes and utensils. Two common configurations are a door-type, where a pivoting door provides access to a treating chamber where dishes are washed or a drawer-type where a drawer provides access to the as well as defining a major portion of the treating chamber. In either configuration, a rack for holding dishes to be cleaned is typically provided within the treating chamber.

BRIEF DESCRIPTION OF THE INVENTION

In one aspect, the disclosure relates to a dish treating appliance for treating dishes according to an automatic cycle of operation comprising a tub at least partially defining a treating chamber and having an access opening to the treating chamber, a cover selectively opening and closing the access opening, and a condenser assembly having a condensing section at least a portion of which is made from a multi-layer material. The condensing section is fluidly coupled to the treating chamber and the multi-layer material attenuates sound emanating from the treating chamber and travels through the condensing section.

In another aspect, the disclosure relates to a dish treating appliance for treating dishes according to an automatic cycle of operation comprising a frame defining an interior and a toe kick area, a tub supported by the frame and at least partially defining a treating chamber with an access opening, a cover selectively opening and closing the access opening, and a condenser assembly. The condenser assembly comprises a condensing section defining a serpentine condensing passage located along a side of the tub and fluidly coupled to the treating section and an outlet section fluidly coupled to the condensing section that extends along the toe kick area.

DESCRIPTION OF EMBODIMENTS OF THE INVENTION

Automatic dishwashers can include a drying cycle which can include heating the treating chamber to evaporate a part of liquid used to wash or rinse the dishes and can include a condenser to further remove humidity from the humid air within the treating chamber. Typical condensers highly depend on the temperature difference between the humid air and the condenser walls. A reduction in this temperature difference reduces condenser efficiency. Often, the walls are thin, requiring minimal cooling to maintain the temperature difference. Condenser walls permit noise to escape from the condenser and the treating chamber, generating noise pollution into a consumer's kitchen or home. In order to combat the noise, sound blankets and other insulation are used to attenuate the noise pollution created by the dishwasher but these add cost and assembly time to the dishwasher.

Figure 1:
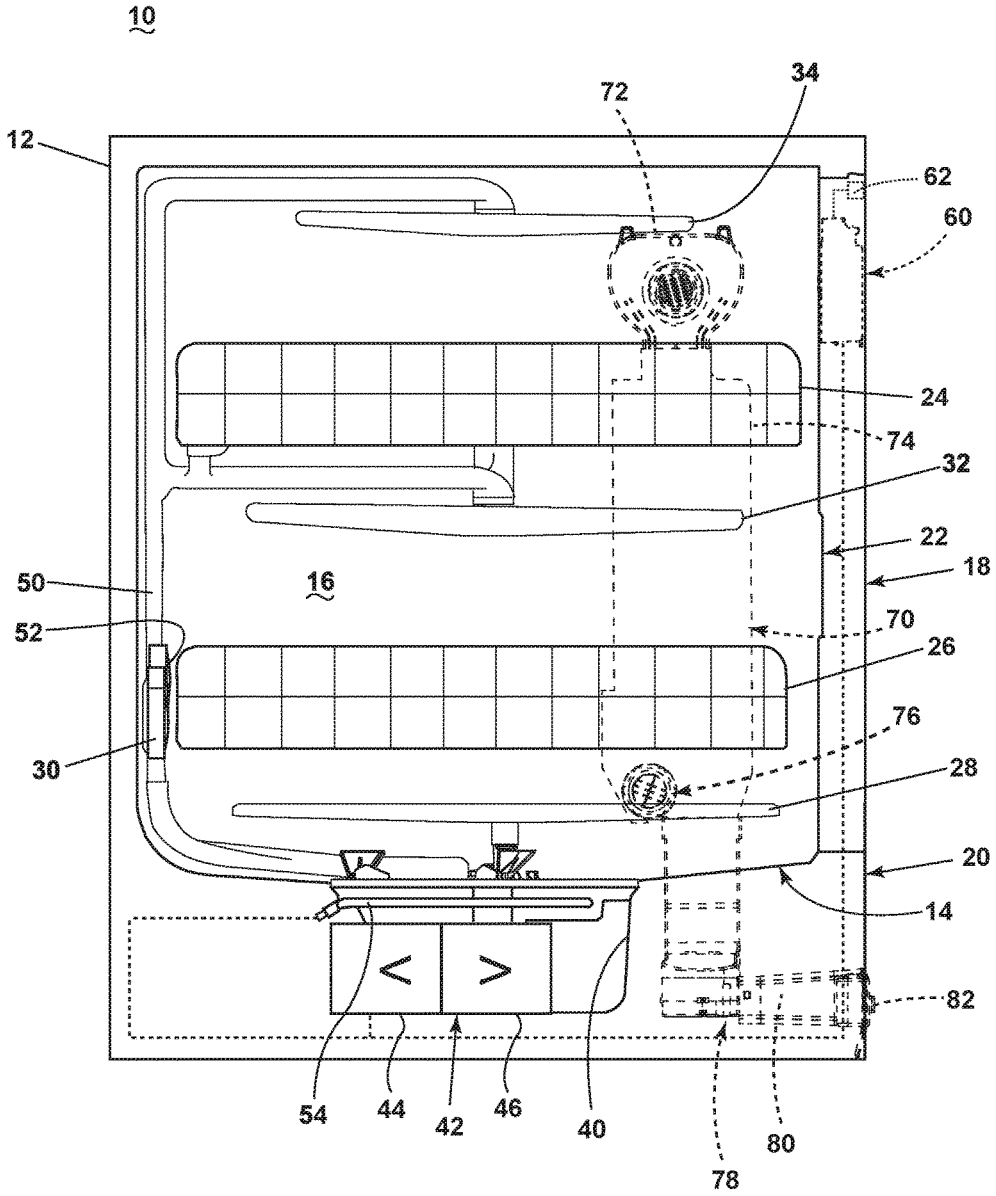
FIG. 1 is a schematic, cross-sectional view of a dishwasher with a condenser.

In FIG. 1, an automated dishwasher 10 includes a chassis 12 to define an interior of the dishwasher 10 and can include a frame, with or without panels mounted to the frame. A tub 14 can be provided within the chassis 12 and can at least partially define a treating chamber 16, having an open face, for washing dishes. A closure such as a cover or a door assembly 18 can be movably mounted to the dishwasher 10 for movement between opened and closed positions to define an access opening 22, the door assembly 18 selectively opening and closing the access opening 22. Thus, the door assembly 18 provides accessibility to the treating chamber 16 through the access opening 22 for the loading and unloading of dishes or other washable items. It should be appreciated that the door assembly 18 can be secured to the lower front edge of the chassis 12 or to the lower front edge of the tub 14 via a hinge assembly (not shown) configured to pivot the door assembly 18. When the door assembly 18 is closed, user access to the treating chamber 16 can be prevented, whereas user access to the treating chamber 16 can be permitted when the door assembly 18 is open.

The chassis 12 can further comprise a bottom panel 20 disposed beneath the pivot point of the door assembly 18. The door assembly 18 is shown in an exemplary closed position, but can be selectably opened to provide access to the treating chamber through an access opening 22.

Dish holders, illustrated in the form of upper and lower dish racks 24, 26, are located within the treating chamber 16 and receive dishes for washing. The upper and lower racks 24, 26 are typically mounted for slidable movement in and out of the treating chamber 16 for ease of loading and unloading. Other dish holders can be provided, such as a silverware basket. As used in this description, the term "dish(es)" is intended to be generic to any item, single or plural, that can be treated in the dishwasher 10, including, without limitation, dishes, plates, pots, bowls, pans, glassware, and silverware.

A spray system is provided for spraying liquid in the treating chamber 16 and is provided in the form of a first lower spray assembly 28, a second lower spray assembly 30, a rotating mid-level spray arm assembly 32, and/or an upper spray arm assembly 34. Upper sprayer 34, mid-level rotatable sprayer assembly 32 and lower rotatable sprayer assembly 28 are located, respectively, above the upper rack 24, beneath the upper rack 24, and beneath the lower rack 26 and are illustrated as rotating spray arms. The second lower spray assembly 30 is illustrated as being located adjacent the lower dish rack 26 toward the rear of the treating chamber 16. The second lower spray assembly 30 is illustrated as including a vertically oriented distribution header or spray manifold 52. Such a spray manifold is set forth in detail in U.S. Pat. No. 7,594,513, issued Sep. 29, 2009, and titled "Multiple Wash Zone Dishwasher," which is incorporated herein by reference in its entirety.

A recirculation system is provided for recirculating liquid from the treating chamber 16 to the spray system. The recirculation system can include a sump 40 and a pump assembly 42. The sump 40 collects the liquid sprayed in the treating chamber 16 and can be formed by a sloped or recessed portion of a bottom wall of the tub 14. The pump assembly 42 can include both a drain pump 44 and a recirculation pump 46. The drain pump 44 can draw liquid from the sump 40 and pump the liquid out of the dishwasher 10 to a household drain line (not shown). The recirculation pump 46 can draw liquid from the sump 40 and the liquid can be simultaneously or selectively pumped through a supply tube 50 to each of the assemblies 24, 26, 28, 30 for selective spraying. While not shown, a liquid supply system can include a water supply conduit coupled with a household water supply for supplying water to the treating chamber 16. A heating system including a heater 54 can be located within the sump 40 for heating the liquid contained in the sump 40 or heating the dishwasher during a drying cycle, for example.

A controller 60 can also be included in the dishwasher 10, which can be operably coupled with various components of the dishwasher 10 to implement a cycle of operation. The controller 60 can be located within the door 18 as illustrated, or it can alternatively be located somewhere within the chassis 12. The controller 60 can also be operably coupled with a control panel or user interface 62 for receiving user-selected inputs and communicating information to the user. The user interface 62 can include operational controls such as dials, lights, switches, and displays enabling a user to input commands, such as a cycle of operation, to the controller 60 and receive information.

A condenser 70 can be provided between the chassis 12 and the tub 14, extending along a side portion of the tub 14. The condenser 70 can mount to the chassis 12 or the tub 14, such as by fastening with fasteners or by welding. An inlet section 72 can provide fluid communication between the treating chamber 16 and the condenser 70 near the top of the treating chamber 16. The inlet section 72 feeds air from the treating chamber 16 to the condensing section 74. The condensing section 74 can comprise an integrated water inlet 76, such that water and condensed liquid can be supplied to the treating chamber 16 from the water inlet 76. An outlet section 78 fluidly couples to the condensing section 74 opposite of the inlet section 72. The outlet section 78 comprises an outlet conduit 80 and an exhaust outlet 82 for exhausting the condensed airflow to the ambient. The outlet section 78 can be formed from multi-layer material or a molded polyester to improve sound attenuation.

Figure 2:
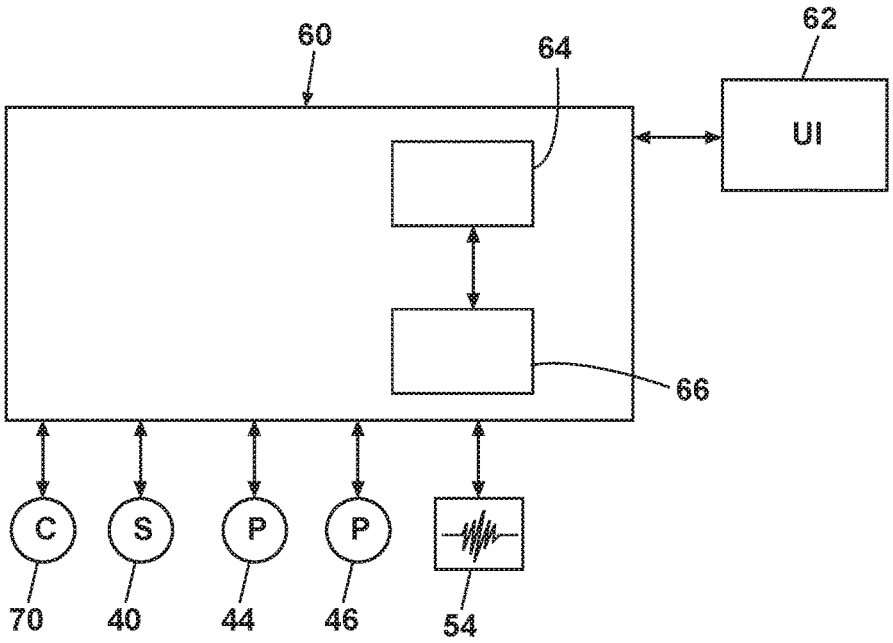
FIG. 2 is a schematic view of a controller of the dishwasher of FIG. 1.

As illustrated schematically in FIG. 2, the controller 60 can be coupled with the heater 54 for heating the wash liquid during a cycle of operation, the drain pump 44 for draining liquid from the treating chamber 16, and the recirculation pump 46 for recirculating the wash liquid during the cycle of operation. Additionally, the controller 60 can be coupled to the condenser 70 for selectively operating the condenser 70 during the cycle of operation, such as a drying cycle. The controller 60 can be provided with a memory 64 and a central processing unit (CPU) 66. The memory 64 can be used for storing control software that can be executed by the CPU 66 in completing a cycle of operation using the dishwasher 10 and any additional software. For example, the memory 64 can store one or more pre-programmed cycles of operation that can be selected by a user and completed by the dishwasher 10. The controller 60 can also receive input from one or more sensors (not shown). Non-limiting examples of sensors that can be communicably coupled with the controller 60 include a temperature sensor and turbidity sensor to determine the soil load associated with a selected grouping of dishes, such as the dishes associated with a particular area of the treating chamber.

Figure 3:
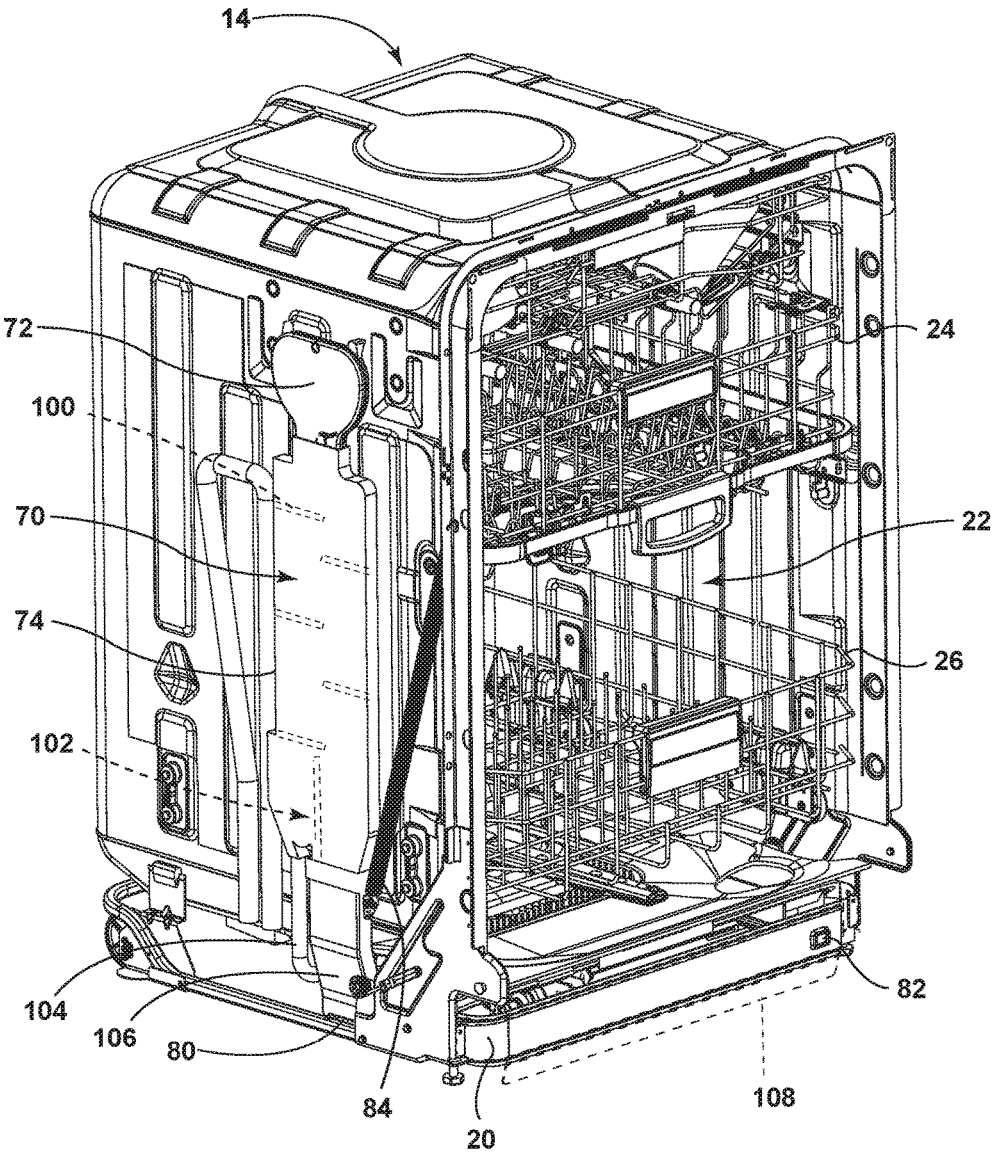
FIG. 3 is a top perspective view of the dishwasher of FIG. 1.

Turning to FIG. 3, the chassis 12 has been removed from the dishwasher 10 illustrating the outer sides of the tub 14. The condenser 70 includes a plurality of walls 100 disposed within the condensing section 74. The walls 100 extend from the sides of the condenser 70 partially across the condensing section 74 internally, defining a serpentine airflow path within the condensing section 74. The condensing section 74 further includes an inlet wall 102, separating the water inlet 76 (FIG. 1) from the rest of the condensing section 74. A supply of water can be fed to the condenser 70 from a water conduit 104, where the supply of water can be fed into the treating chamber 16 through the water inlet 76. The condenser 70 can mount to the tub 14 or, alternatively, the chassis 12 by a suspension 84, illustrated as an exemplary spring.

An intermediate conduit 106 fluidly couples the condenser conduit 74 to the outlet section 78. The outlet conduit 80 can run along the bottom of the dishwasher 10, behind the bottom panel 20, exhausting the condensed air through the exhaust outlet 82. Additionally, the bottom panel 20 can comprise a toe kick area 108, extending below the bottom panel 20. The toe kick area 108 can comprise, for example, a kick plate preventing a user from kicking the outlet section 78. The outlet conduit 80 can extend along the toe kick area 108 having the exhaust outlet 82 located opposite of the condensing section 74 relative to the dishwasher 10. The outlet conduit 80 can extend along part of or the entire toe kick area 108, defined by placement of the exhaust outlet 82.

Figure 4:
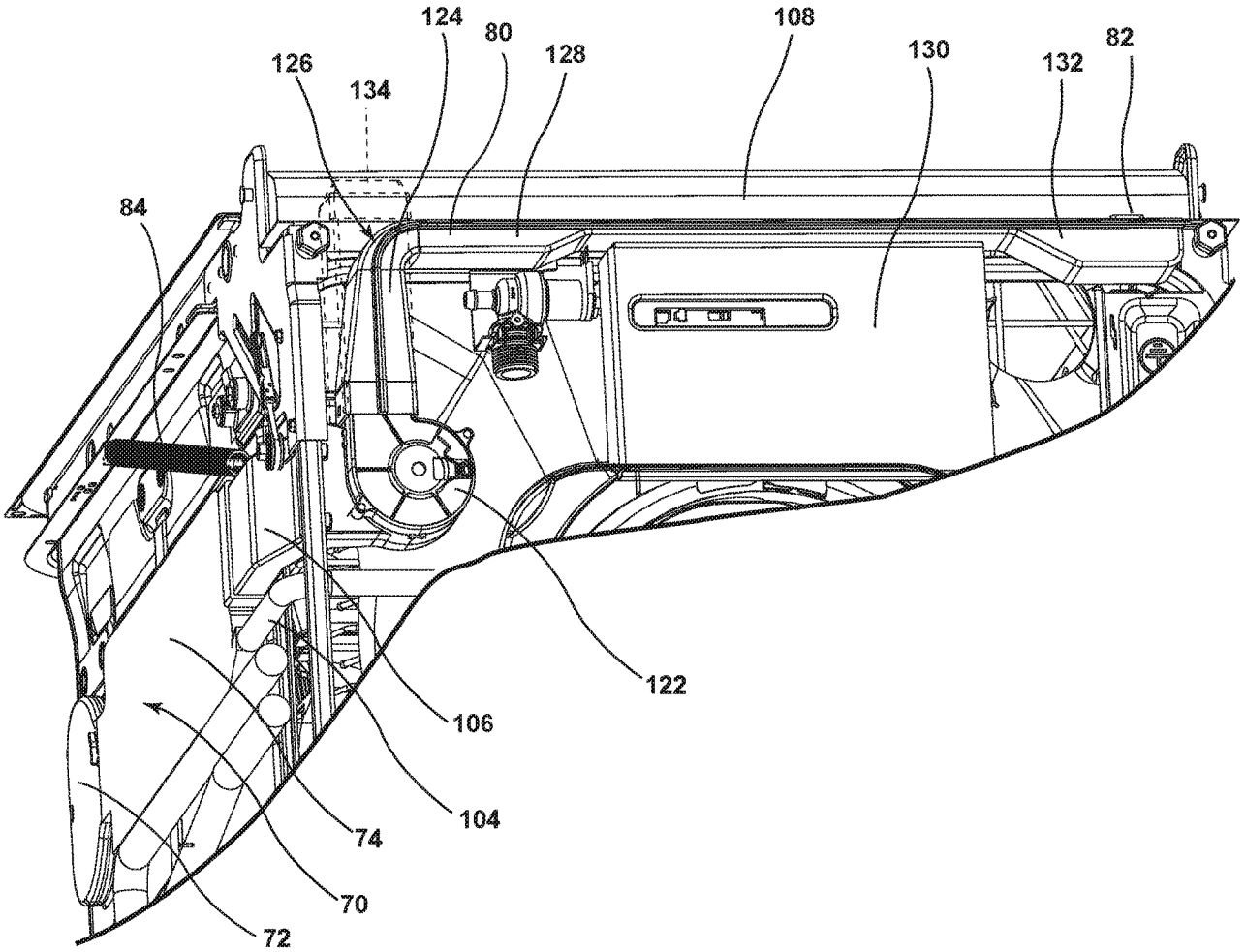
FIG. 4 is a bottom perspective view of the dishwasher of FIG. 3 illustrating an outlet section of the condenser showing a typical outlet in dashed line.

Turning now to FIG. 4, a bottom perspective view of the dishwasher 10 best illustrates the outlet section 78 of the condenser 70. The outlet section 78 couples to the condensing section 74 via the intermediate conduit 106, feeding a fan 122 of the condenser 70 the condensed air from the condensing section 74. The fan 122 can draw moist air from the treating chamber 16 through the inlet section 72 and into the condensing section 74 to condense the moist air.

The outlet conduit 80 can further comprise a forward conduit section 124, a ducting turn 126, a lateral conduit section 128, and an exhaust section 132. The fan 122 pushes the condensed air through a forward conduit section 124 of the outlet conduit 80. The forward conduit section 124 moves the condensed air toward the front of the dishwasher 10 where it turns at a ducting turn 126 and moves along the front of the dishwasher 10 along a lateral conduit section 128. The lateral conduit section 128 extends along at least a portion of the toe kick area 108. The lateral conduit section 128 fluidly couples to an exhaust section 132 where the condensed air exhausts through the exhaust outlet 82. The lateral conduit section 128 can mount to the bottom of the tub 14 or to a cover plate 130 for covering the controller.

A contemporary exhaust outlet 134 utilized in the prior art is shown in dashed line. The contemporary exhaust outlet 134 is located such that the fan 122 typically pushes the condensed air forward and immediately out of the condenser 70 and dishwasher 10. The noise associated with the fan 122 also travels out the typical exhaust outlet 134, generating a noise audible and recognizable by a user. Replacement of the contemporary exhaust outlet 134 with the illustrated and above described outlet section 78 greatly reduces the amount of noise emitted from the dishwasher 10.

The condenser 70, referred to hereinafter as a condenser assembly 70, can comprise one or more of the inlet section 72, the condensing section 74, the outlet section 78, the outlet conduit 80, the exhaust outlet 82, the intermediate conduit 106, the fan 122, the forward conduit 124, the turn 126, the lateral conduit section 128, and the exhaust section 132. Contemporary drying systems also utilize plastic, which does not contribute much for sound attenuation. The condenser assembly 70 described herein can be made of a multi-layer material or a molded polyester, both of which provide better sound attenuation.

Figure 5:
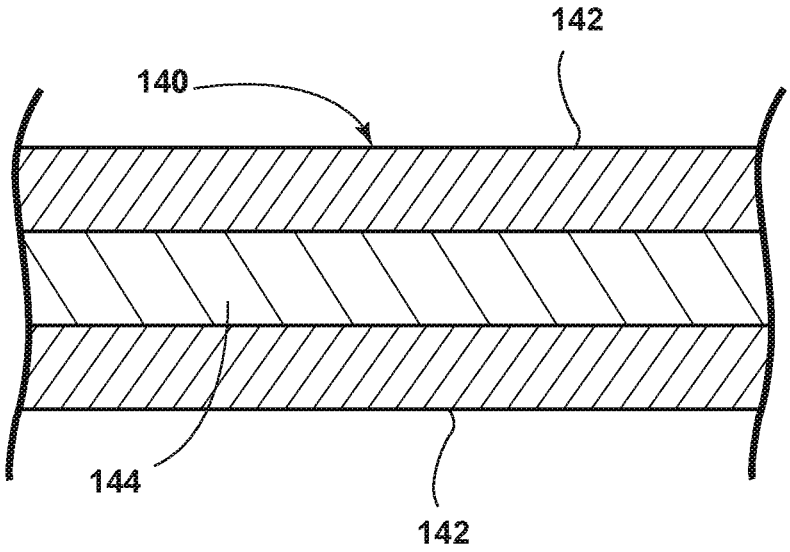
FIG. 5 is a schematic, cross-sectional view of the condenser walls showing a multi-layer material.

FIG. 5 illustrates a multi-layer absorptive acoustic material 140 that can be utilized in portions of the condenser assembly 70. Such a multi-layer material 140 attenuates the sound emanating from the treating chamber 16 and travelling through the condenser assembly 70 and out the outlet conduit 80, as well as sounds generated by the fan 122 and the pump assembly 42. The multi-layer material 140 can comprise multiple layers of molded polyester or other materials. The multi-layer material 140 can include, but is not limited to, two outer layers of polyester 142 with an inner layer of plastic 144 between the polyester layers 142 to form a composite acting as a moisture barrier. The total thickness of the multi-layer material 140 can be a minimum of 2.0 millimeters (mm) and a maximum of 25 mm. During a drying cycle, most of the noise generated by the dishwasher 10 is emanated as airborne noise. The multi-layer material 140 attenuates the airborne noise. Changing the noise frequency to a lower frequency to provide a more appealing sound quality. This reduces the dry noise sound of the dishwasher 10 and reduces the overall spectrum of the dry noise.

Figure 6:
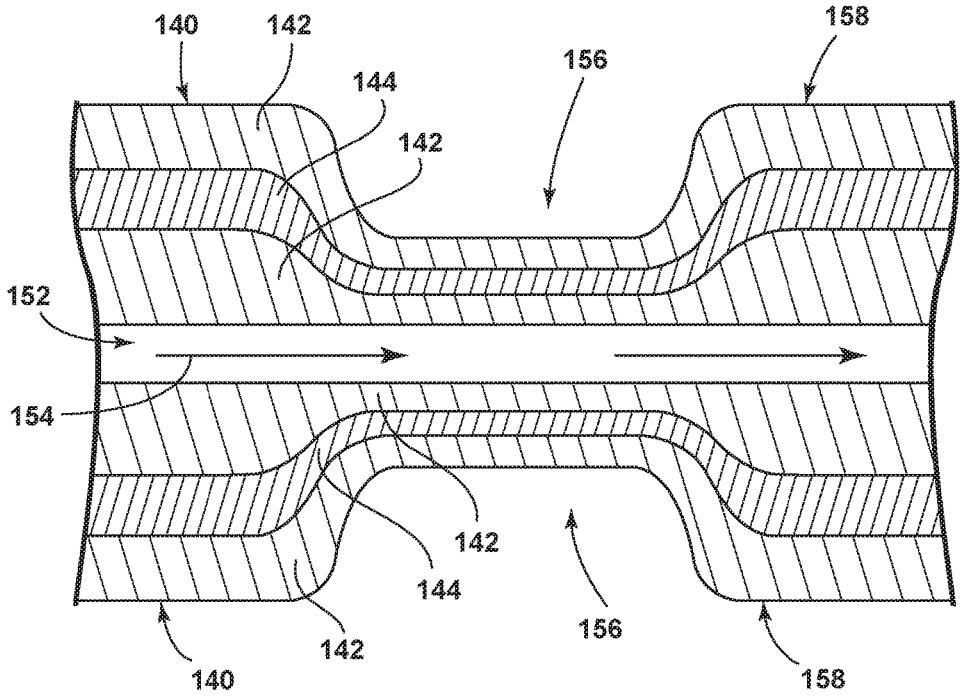
FIG. 6 is a schematic, cross-sectional view of the multi-layer material showing compressed and non-compressed sections.

Turning to FIG. 6, the multi-layer material 140 can further be compressed where required to accommodate for the condenser assembly 70, while remaining non-compressed where sound absorption is required. The multi-layer material 140 can have an interior flow conduit 152, which can be any conduit described herein, for directing a flow of air 154 through the condenser 70. A compressed portions 156 can be compressed to modify the condenser geometry by reducing the thickness of a portion of the condenser 70 providing additional dishwasher space where necessary. Non-compressed portions 158 can be utilized where sound attenuation is required, as the non-compressed portions 158 provide increased noise attenuation relative to the compressed portions 156.

It should be appreciated that the layered structure as illustrated in FIG. 5 is merely exemplary and that the multi-layer material 140 can comprise additional layering configurations, such as more or less layers, having additional or alternative materials between layers of polyester, etc. In one such example, the multi-layer material 140 can include a compressed four-layer material having two outer layers of polyester with two middle plastic layers. Additionally, polyester and plastic materials are exemplary and can be replaced with any suitable materials for attenuating noise within the condenser assembly 70.

Figure 7:
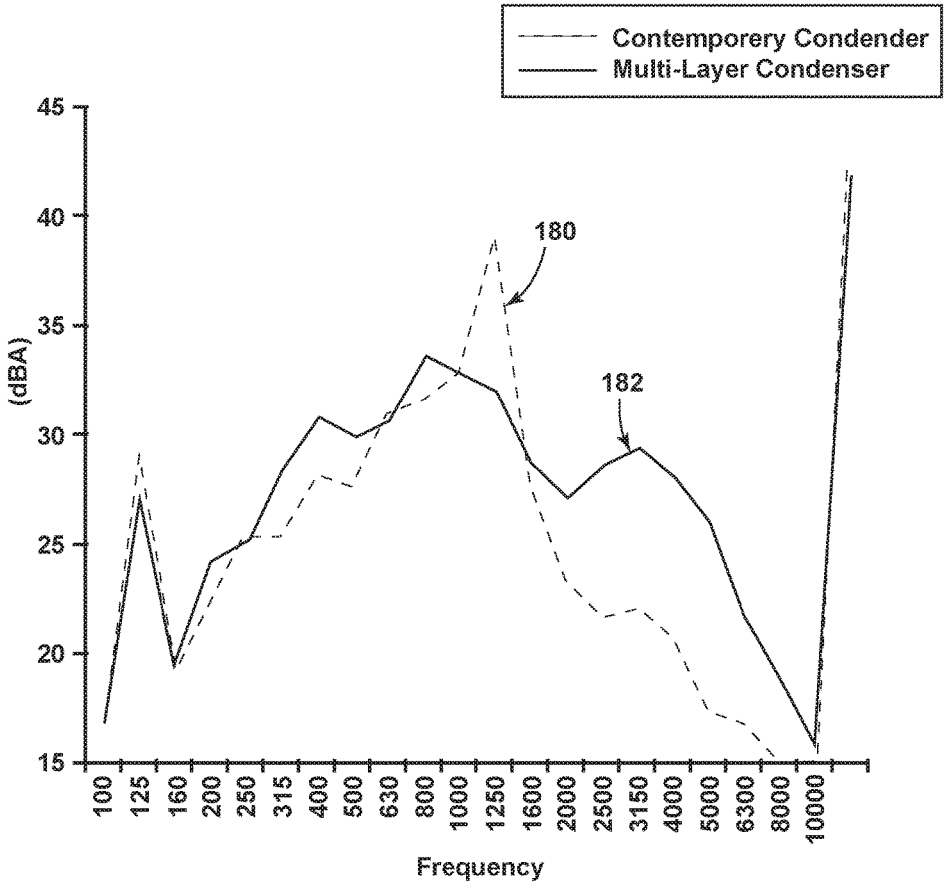
FIG. 7 is a plot illustrating exemplary decibel levels for the dishwasher of FIG. 1 and a contemporary dishwasher.

Looking at FIG. 7, a plot illustrates the decibel levels 180 for a similar dishwasher at different frequencies for a contemporary condenser and decibel levels 182 for the dishwasher 10 having a condenser assembly 70 utilizing the multi-layer material 140. The decibel levels 180 for the contemporary condenser include a maximum decibel (dBA) level of about 39 dBA at 1250 Hertz (Hz), while the decibel levels 182 for the condenser assembly 70 having the multi-layer material 140 has a maximum decibel level of about 34 dBA at a frequency of about 800 Hz. The multi-layer material 140 is beneficial in attenuating the noise, decreasing the overall decibel level of the condenser assembly 70, and shifting the frequency at which the highest decibel level occurs.

Furthermore, the multi-layer absorptive acoustic material 140 can attenuate the high frequency sound, as compared to a single layer of hard plastic material. Additionally, the multi-layer material 140 improves psychoacoustic metrics, such as time decay, loudness, and pleasantness, which helps to gain perception of improved drying sounds quality. The sound then emitted from the condensing section 72 is quieter, having less frequency content as compared to a single-layer plastic material. Overall sound quality emitted from the condenser assembly 78 is improved.

Figure 8:
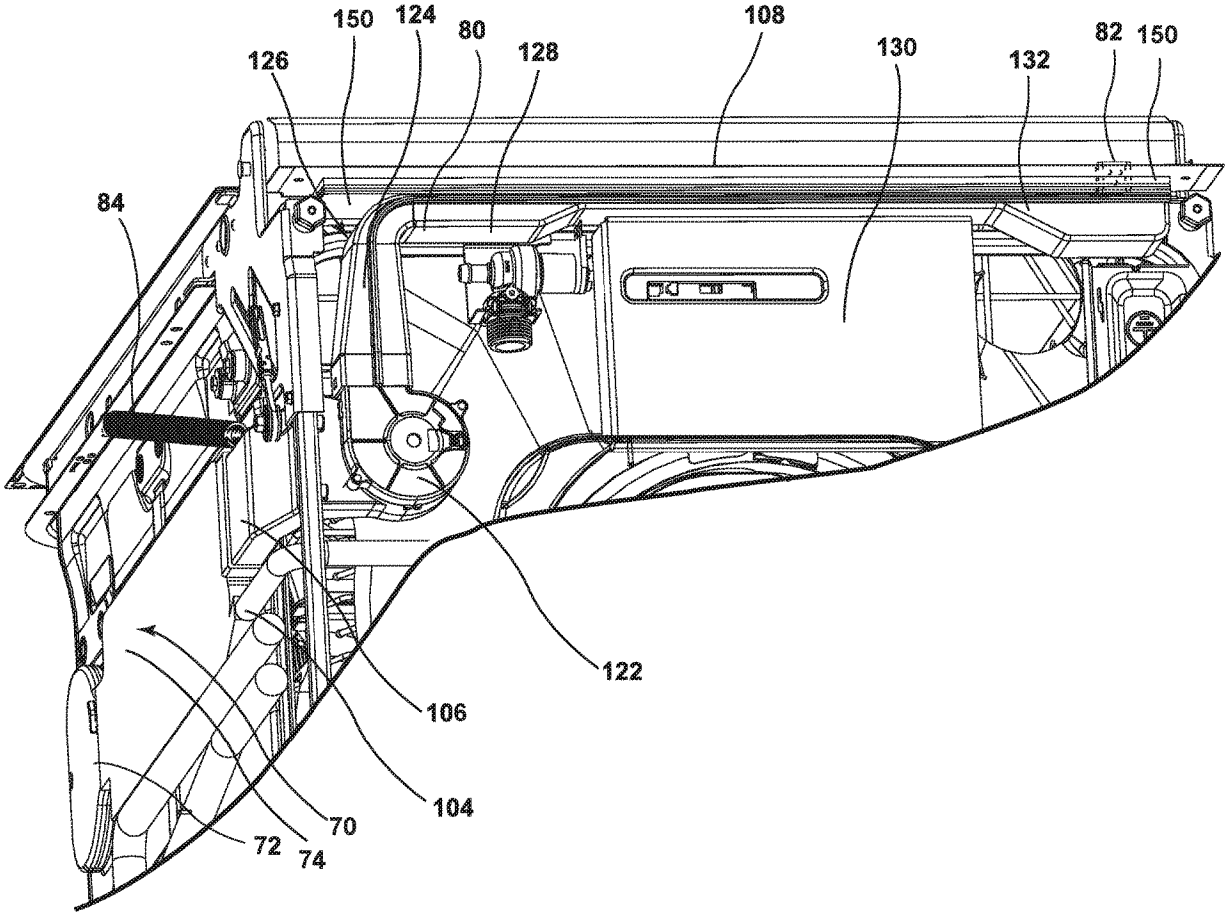
FIG. 8 is a bottom perspective view of the dishwasher of FIG. 3 having a toe kick area with insulation.

Turning now to FIG. 8, it can be appreciated that the toe kick area 108 can be moved forward, relative to the front of the dishwasher 10. The forward disposition of the toe kick area 108 provides room for inserting layered insulation 150, illustrated in dashed line, between the lateral conduit section 128 and the toe kick area 108. While it is contemplated that the multi-layer material 140 can eliminate the need for insulation, FIG. 8 contemplates utilizing additional insulation 150 between the condenser assembly 78 and the toe kick area 108. It will be understood that the insulation 150 can be a minimal amount and that the overall insulation requirement for the dishwasher 10 can still be reduced as compared to contemporary machines. Thus, insulation cost can be reduced and space within the dishwasher chassis 12 is increased with less utilized insulation 150.

It should be appreciated that the condenser assembly 70 in combination with the use of a multi-layer material 140 provides for attenuation of noise generated by the dishwasher 10. The reduced noise provides for quieter operation with less frequency content for a preferable consumer experience. Additionally, the reduced noise levels require minimal or no insulation for noise attenuation for the condenser assembly 70, increasing utilizable space within the dishwasher unit without increasing the overall noise of the dishwasher. Furthermore, the reduction of insulation reduces overall production cost for the unit. Routing the lateral conduit section 128 of the outlet conduit 80 and the condenser assembly 70 across the toe kick area 108 provides additional space for reducing the noise moving with the dry air. The increased space increases overall time in which air travels through the condenser assembly 70, providing for longer opportunity to attenuate the condenser noise. The multi-layer material 140, that can include materials such as polyester provides, for a reduction in overall decibel levels of the noise moving through the condenser unit as well as minimizes the frequency of the noise, providing a more appealing sound quality.

To the extent not already described, the different features and structures of the various embodiments may be used in combination with each other as desired. That one feature may not be illustrated in all of the embodiments is not meant to be construed that it may not be, but is done for brevity of description. Thus, the various features of the different embodiments may be mixed and matched as desired to form new embodiments, whether or not the new embodiments are expressly described. All combinations or permutations of features described herein are covered by this disclosure.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention, which is defined in the appended claims.

What is claimed is:

1. A dish treating appliance for treating dishes according to an automatic cycle of operation, the dish treating appliance comprising:

a tub at least partially defining a treating chamber and having an access opening to the treating chamber;

a cover selectively opening and closing the access opening; and a condenser assembly having a conduit section that defines a passage and where the conduit section comprises a multi-layer absorptive acoustic material that includes at least two layers of molded polyester wherein the conduit section is fluidly coupled to the treating chamber and the multi-layer absorptive acoustic material is configured to attenuate sound emanating from the treating chamber and traveling through the conduit section and wherein the multi-layer absorptive acoustic material is also configured to change a noise frequency of the sound to a lower frequency.

2. The dish treating appliance of claim 1 wherein the multi-layer absorptive acoustic material is further configured to improve psychoacoustic metrics including at least one of time decay, loudness, or pleasantness of the sound.

3. The dish treating appliance of claim 1 wherein the multi-layer absorptive acoustic material comprises a plastic layer between the at least two layers of molded polyester to form a composite.

4. The dish treating appliance of claim 3 wherein the composite acts as a moisture barrier.

5. The dish treating appliance of claim 4 wherein at least a portion of the composite is compressed to form a compressed portion and at least a portion of the composite is non-compressed to form a non-compressed portion and wherein the non-compressed portion provides an increased noise attenuation relative to the compressed portion.

6. The dish treating appliance of claim 5 wherein the composite has a minimum thickness of 2 mm and a maximum thickness of 25 mm.

7. The dish treating appliance of claim 6 wherein the sound emitted from the conduit section is quieter with less frequency content or has a better sound quality than the sound emitted from a conduit section made from a single layer of a plastic material.

8. The dish treating appliance of claim 1 wherein the condenser assembly further comprises an outlet section fluidly coupled to the conduit section and where the outlet section includes an outlet conduit formed from the multi-layer absorptive acoustic material and wherein the outlet conduit extends along at least a portion of a length of a toe kick area of the dish treating appliance and attenuates additional sound.

9. The dish treating appliance of claim 8 wherein the outlet section extends along an entire length of the toe kick area.

10. The dish treating appliance of claim 1 wherein the conduit section defines a serpentine condensing passage.

11. A dish treating appliance for treating dishes according to an automatic cycle of operation, the dish treating appliance comprising:

a frame defining an interior and a toe kick area;

a tub including at least one sidewall and where the tub is supported by the frame and at least partially defining a treating chamber with an access opening wherein the access opening is located above the toe kick area;

a cover selectively opening and closing the access opening; and a condenser assembly, comprising:

a condensing section including walls extending from sides of a condenser to define a serpentine condensing passage located along a sidewall of the tub and fluidly coupled to the treating chamber, and an outlet section fluidly coupled to the condensing section and comprising an outlet conduit that extends along at least a portion of a length of the toe kick area wherein the outlet conduit comprises a molded polyester absorptive acoustic material and wherein the outlet conduit is configured to attenuate airborne noise produced by the dish treating appliance.

12. The dish treating appliance of claim 11 wherein the outlet conduit extends along a full length of the toe kick area.

13. The dish treating appliance of claim 11 wherein the molded polyester absorptive acoustic material is further configured to attenuate high frequency sound as compared to a single layer of a plastic material.

14. The dish treating appliance of claim 13 wherein the molded polyester absorptive acoustic material is further configured to improve psychoacoustic metrics, such as time decay, loudness, and pleasantness as compared to the same material in a single layer of the plastic material.

15. The dish treating appliance of claim 11 wherein the molded polyester absorptive acoustic material is a multi-layer molded polyester absorptive acoustic material having a minimum thickness of between 2 mm and a maximum thickness of 25 mm.

16. The dish treating appliance of claim 15 wherein a portion of the multi-layer absorptive acoustic material is compressed to form a compressed geometry, and a second portion of the multi-layer absorptive acoustic material is non-compressed and wherein the non-compressed portion provides an increased noise attenuation relative to the compressed portion.

17. A dish treating appliance for treating dishes according to an automatic cycle of operation, the dish treating appliance comprising:

a frame defining an interior and a toe kick area;

a tub including at least one sidewall and where the tub is supported by the frame and at least partially defining a treating chamber with an access opening wherein the access opening is located above the toe kick area;

a cover selectively opening and closing the access opening; and a condenser assembly, comprising:

a condensing section fluidly coupled to the treating chamber; and an outlet section fluidly coupled to the condensing section and comprising an outlet conduit that extends along at least a portion of a length of the toe kick area and wherein the outlet conduit comprises a multi-layer absorptive acoustic material including at least a layer of polyester and a layer of plastic; and a fan configured to draw moist air from the treating chamber through the condensing section to condense the moist air and define condensed air and where the fan is configured to push the condensed air through the outlet section;

wherein the outlet conduit is configured to attenuate noise produced by the fan.

18. The dish treating appliance of claim 17 wherein the outlet conduit includes a forward conduit section mounted to the fan and configured to move the condensed air toward a front of the dish treating appliance, a ducting turn mounted to the forward conduit section and a lateral conduit section extending along at least a portion of the toe kick area and configured to move the condensed air along the front of the dish treating appliance.

19. The dish treating appliance of claim 18 wherein at least a portion of the multi-layer absorptive acoustic material forming the forward conduit section is compressed to form a compressed portion and at least a portion of the multi-layer absorptive acoustic material forming the forward conduit section is non-compressed to form a non-compressed portion.

20. The dish treating appliance of claim 18 wherein the multi-layer absorptive acoustic material includes at least two outer layers of polyester with at least one inner layer of plastic.

21. The dish treating appliance of claim 18, further comprising layered insulation between the lateral conduit section and the toe kick area.

* * * * *